US006435445B1

(12) United States Patent
Slezak

(10) Patent No.: US 6,435,445 B1
(45) Date of Patent: Aug. 20, 2002

(54) SELF-COMPENSATING FILAMENT TENSION CONTROL DEVICE EMPLOYING A FRICTION BAND

(75) Inventor: Raymond J. Slezak, Barberton, OH (US)

(73) Assignee: RJS Corporation, Akron, OH (US)

( * ) Notice: Subject to any disclaimer, the term of this patent is extended or adjusted under 35 U.S.C. 154(b) by 8 days.

(21) Appl. No.: 09/604,364

(22) Filed: Jun. 27, 2000

Related U.S. Application Data

(63) Continuation-in-part of application No. 09/151,552, filed on Sep. 11, 1998, now Pat. No. 6,098,910.

(51) Int. Cl.[7] ..... B65H 59/16; B65H 77/00; F16D 51/06

(52) U.S. Cl. ..... 242/421.9; 242/156; 242/422.8; 188/77 W

(58) Field of Search ..... 242/421, 421.5, 242/421.8, 421.9, 422.8, 156; 188/77 R, 77 W

(56) References Cited

U.S. PATENT DOCUMENTS

| | | | | |
|---|---|---|---|---|
| 268,235 | A | * 11/1882 | Hubbard | 242/421.8 X |
| 724,975 | A | 4/1903 | Wardwell | |
| 1,031,487 | A | 7/1912 | Taylor | |
| 1,100,039 | A | 6/1914 | Tyler et al. | |
| 1,103,144 | A | 7/1914 | Hunting | 242/421.9 |
| 1,395,830 | A | 11/1921 | Jones | 242/421.9 |
| 1,462,604 | A | 7/1923 | Lavalle | |
| 1,475,855 | A | 11/1923 | Murdock | |
| 1,640,532 | A | 8/1927 | Coldwell | 242/422.4 X |
| 1,946,313 | A | 2/1934 | Daniels | 242/156 |
| 2,149,940 | A | 3/1939 | Kylin | 188/74 X |
| 2,472,548 | A | 6/1949 | Schnell | 242/75 |
| 2,766,945 | A | 10/1956 | Reich | 242/45 |
| 2,879,011 | A | 3/1959 | Nelson | 242/156.2 |
| 2,983,468 | A | 5/1961 | Perrella | 242/156.2 |
| 3,076,618 | A | 2/1963 | Van Hook | 242/75.42 |
| 3,081,957 | A | 3/1963 | Van De Bilt | 242/54 |
| 3,182,961 | A | 5/1965 | Le Bus, Sr. | 242/421.8 |
| 3,223,352 | A | 12/1965 | Fuller et al. | 242/156.2 |
| 3,355,122 | A | 11/1967 | Thatcher | 242/75.43 |
| 3,540,675 | A | 11/1970 | Goldsworthy | 242/156.2 |
| 3,731,889 | A | 5/1973 | Alexeff | 242/156.2 |
| 3,899,143 | A | 8/1975 | Slezak | 242/156.2 |
| 3,904,147 | A | * 9/1975 | Taitel et al. | 242/421.8 X |
| 4,139,165 | A | 2/1979 | Dyck | 242/421 |
| 4,460,072 | A | * 7/1984 | Morner et al. | 188/77 R |
| 4,664,232 | A | 5/1987 | Takagi et al. | 188/74 |
| 5,314,136 | A | 5/1994 | Vaida et al. | 242/421.8 |
| 5,524,834 | A | * 6/1996 | Bogucki-Land | 242/421.8 |
| 5,573,194 | A | * 11/1996 | Park | 242/422.8 X |
| 5,609,310 | A | * 3/1997 | Kobayashi | 242/421.8 X |
| 6,010,089 | A | * 1/2000 | Winafeld et al. | 242/421.8 |
| 6,098,910 | A | * 8/2000 | Slezak | 242/421 |

FOREIGN PATENT DOCUMENTS

| | | |
|---|---|---|
| JP | 60048872 | 3/1985 |
| JP | 61060571 | 3/1986 |
| JP | 09086790 | 3/1997 |

* cited by examiner

*Primary Examiner*—Michael R. Mansen
*Assistant Examiner*—Minh-Chau Pham
(74) *Attorney, Agent, or Firm*—Renner, Kenner, Greive, Bobak, Taylor & Weber

(57) ABSTRACT

A self-compensating tension control device for regulating the payout of filamentary material from a spool includes a fixed support and a spindle assembly pivotably mounted to the fixed support, wherein the spindle assembly rotatably carries the spool of filamentary material. A pull-off force imparted by the filamentary material causes angular movement of the spindle assembly and rotation of the spool. A braking assembly mounted to the fixed support and coupled to the spindle assembly applies a braking force corresponding to an angular position of the spindle assembly.

10 Claims, 11 Drawing Sheets

SELF-COMPENSATING FILAMENT TENSION CONTROL DEVICE EMPLOYING A FRICTION BAND

CROSS REFERENCE TO RELATED APPLICATION

This is a continuation-in-part of copending patent application Ser. No. 09/151,552, now U.S. Pat. No. 6,098,910 filed Sep. 11, 1998, entitled "Self-Compensating Filament Tension Control Device".

TECHNICAL FIELD

The present invention relates generally to an automatic tension control device for regulating the amount of tension under which a filamentary material is withdrawn from a spool. More particularly, the present invention relates to such a tension control device which tends to maintain substantially constant tension in filamentary materials over variances in operating parameters. More specifically, the present invention relates to such a tension control device which employs a suspended spindle operative with a band brake assembly, thereby tending to maintain substantially constant tension in a filament.

BACKGROUND ART

Filamentary materials include fibers in single and multiple strands, flat bands, or tubing produced in long lengths and conveniently wound on spools. The various filamentary materials may be either natural or synthetic fibers, glass or metal. Such materials are commonly utilized as reinforcements for plastic or elastomeric compounds or may themselves be fabricated into integral items as in the textile industry. Regardless of the application, it is customary to withdraw the filamentary material from the spool at or near the location it is being used. To facilitate such removal, the spool is customarily mounted on a spindle or let-off device which permits the spool to rotate as the filament is withdrawn.

Because payout of the filament from the spool may be at a high linear velocity, thereby imparting substantial momentum to the spool and related spindle mounting components, it is necessary to dissipate force rapidly in the event the filament breaks or the take-up velocity suddenly decreases. In either situation, filament tends to be payed out more rapidly than it is needed until rotation of the spool can compensate. Obviously, the problem is greatly multiplied when a creel assembly carrying up to several hundred spools is being used. Numerous braking devices have been developed for use with creels. Many of these provide for the filament to be payed out under tension greater than what is required for payout from the spool. As the tension decreases, with slack in the filament, the braking force is applied to slow the rotation of the spool. Further, the amount of tension to be maintained in the filament must be variable in order to accommodate operations with different filaments under various conditions. In the past, such creels having variable tension control have often required multiple individual adjustments and have not been desirably compact. Some designs have even required tension adjustments during payout of the filament, as the spool is emptied. In other instances, creels have exhibited undesirable hunting or loping in the form of periodic variations about a desired tension, particularly in high-tension applications.

One of the more commercially successful tension control devices used in the tire industry is in accordance with Applicant's U.S. Pat. No. 3,899,143. That device has a support structure which carries a spool support and a separately mounted rotatable pivot shaft. A first lever arm fixed on the pivot shaft carries a guide for tensioning the filamentary material as it is withdrawn from a spool mounted on the spool support and a brake which selectively engages the spool support. A second lever arm fixed on the pivot shaft is operatively connected with an air cylinder which effects a biasing that is transmitted to the first lever arm via the pivot shaft.

Tension control devices according to U.S. Pat. No. 3,899,143 have demonstrated exemplary operating characteristics under a variety of conditions and with a variety of filaments. However, there are several situations in which these tension control devices are not well suited. It has been found that the control arm and guide roller are vulnerable to damage from over-tension possibly caused by entanglement of the spooled material. In instances where the filamentary material is a heavy gauge wire, the guide roller imparts a "cast" or distortion to the shape of the wire. This may lead to a less than satisfactory end product or the need to provide additional manufacturing equipment to straighten the wire. To the present time, there has been no comprehensive device for dispensing heavy filamentary material from a spool. Yet a third problem is that the control arm and roller inhibits closely mounting the multiple tension controllers on the creel assembly.

One way to overcome the foregoing problems associated with the prior art is to provide a tension control device in which the spool is carried by a pivotably mounted spindle assembly that is moveable with a pivotably mounted braking assembly. By utilizing a fixed cam that engages the braking assembly, the rotation of the spindle is inhibited whenever a predetermined tension force is absent from the filamentary material. The braking assembly is provided with a slidable block with cam bearings that are spring-biased against a curvilinear cam surface provided by the cam. This provides a gradual yet firm application or removal of a braking force depending upon the amount of tension applied to the filamentary material. The braking force, applied through the cam, adjusts in response to the varying tension of the material as it unwinds from the spool. An increasing tension accordingly acts on the pivotably mounted spindle assembly causing the braking force to be relieved by an increasing amount, thereby tending to keep the filament in constant tension; conversely, a decreasing tension causes a greater braking force to be applied, with full braking (within the limits of the device) at zero tension.

DISCLOSURE OF INVENTION

It is, therefore, an object of the present invention to provide a tension control device for filamentary material which provides for payout of a filamentary material at a uniform tension selected from a substantial range, irrespective of the rate at which the filament is taken up. It is another object of the present invention to provide such a tension control device which maintains substantially uniform tension on the filamentary material during payout, irrespective of the amount of filamentary material remaining on a spool. It is a further object of the present invention to provide such a tension control device which is relatively compact and readily adjusted so as to accommodate various heavy filamentary materials.

It is yet another object of the present invention to provide a tension control device for filamentary material which may be selectively loaded by a loading device to provide any desired tension setting over an operating range covering the applications for a particular device constructed according to the invention.

It is a further object of the present invention to provide a tension control device that does not impart a distortion to the filamentary material as it is withdrawn from a spool. It is still another object of the present invention to provide a predetermined threshold to the loading device which applies a braking force to the rotation of the spool which is overcome by a tension force applied by the filamentary material.

It is another object of the present invention to provide a tension control device in which the spool is carried by a pivotably mounted spindle assembly that is movable with a pivotably mounted braking assembly. It is still another object of the present invention to provide a fixed cam that engages the braking assembly and inhibits rotation of the spindle assembly whenever a predetermined tension force is absent from the filamentary material. A further object of the present invention is to provide the braking assembly with a slidable block with cam bearings that are spring-biased against a curvilinear cam surface provided by the cam to provide a gradual yet firm application or removal of braking force. It is still another object of the present invention to construct the interrelationship between the cam and the braking assembly so that as the tension force acting on the spindle changes, the braking force applied to the spindle changes, thereby tending to keep the filament tension constant.

It is still another object of the present invention to provide such a tension control device which may be combined with a plurality of such devices wherein the tension setting for the devices may be readily varied remotely by a single adjustment.

It is yet an additional object of the present invention to provide a tension control device, as described above, except wherein the fixed cam and brake shoe are replaced by a friction band brake assembly. It is still another object of the present invention to provide pivotable movement of the spindle assembly to allow for engagement by the friction band with varying applications of a braking force. As in the first embodiment, the spindle assembly is selectively loaded so as to initially exert a braking force on the spindle assembly.

It is yet another object of the present invention to assist the selectively loaded force by positioning the ends of the friction band so that each end is a different distance from the spindle assembly's pivot point. It is still another object of the present invention to set the different distances of the braking band such that as tension is applied to the filamentary material, the tension forces overcome the loading force and the spindle moves to a position less restricted by the friction band and rotates. Accordingly, as the tension applied to the filamentary material is reduced, the spindle assembly rotates into a position where a larger amount of braking force is applied and rotation of the spool is reduced. It is still an additional object of the present invention to provide such a tension control device, wherein one end of the band is adjustable to change its distance from the center of the pivotably mounted spindle assembly.

It is yet another object of the present invention to allow for spring-biasing of the band's ends to accommodate spindle movement during payout of the filamentary material and ensure more uniform withdrawal thereof.

It is still yet another object of present invention to preferably spring-bias the adjustable end, although the fixed end could also be spring-biased separately or together with the adjustable end.

At least one or more of the foregoing objects of the present invention, together with the advantages thereof over existing and prior art forms of filament tension control devices which will become apparent from the following description, are accomplished by the invention hereinafter described and claimed.

In general, the present invention contemplates a self-compensating tension control device for regulating the payout of filamentary material from a spool, comprising a fixed support, a spindle assembly pivotably mounted to the fixed support, the spindle assembly rotatably carrying the spool of filamentary material, wherein a pull-off force imparted by the filamentary material causes angular movement of the spindle assembly and rotation of the spool, and a braking assembly mounted to the fixed support and coupled to the spindle assembly, wherein the amount of braking force applied by the braking assembly corresponds to an angular position of the spindle assembly.

BRIEF DESCRIPTION OF THE DRAWINGS

FIG. 11 A is an enlarged cross-sectional view of an extension arm and a straight arm of the device taken substantially along lines 11A—11A of FIG. 11.

PREFERRED EMBODIMENT FOR CARRYING OUT THE INVENTION

Figure 1:
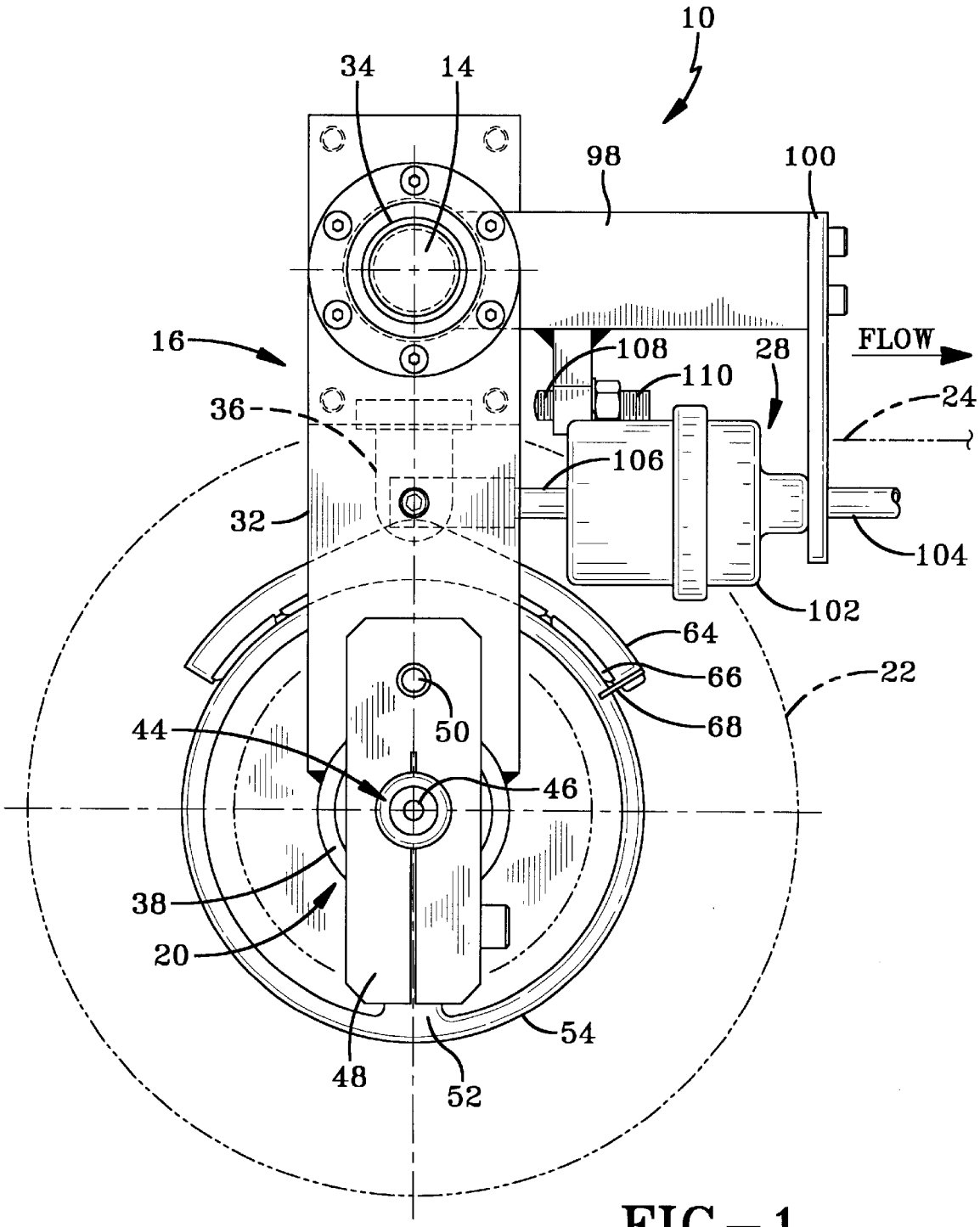
FIG. 1 is a front-elevational view of a self-compensating filament tension control device, embodying the concepts of the present invention, wherein a spool of filamentary material is shown in phantom and wherein the device controls rotation of the spool.
Figure 6:
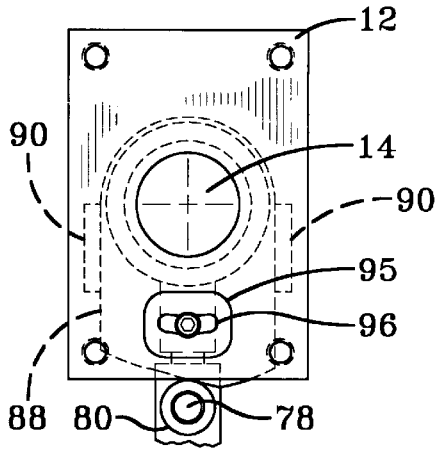
FIG. 6 is a side view of the device taken substantially along line 6—6 of FIG. 2.
Figure 2:
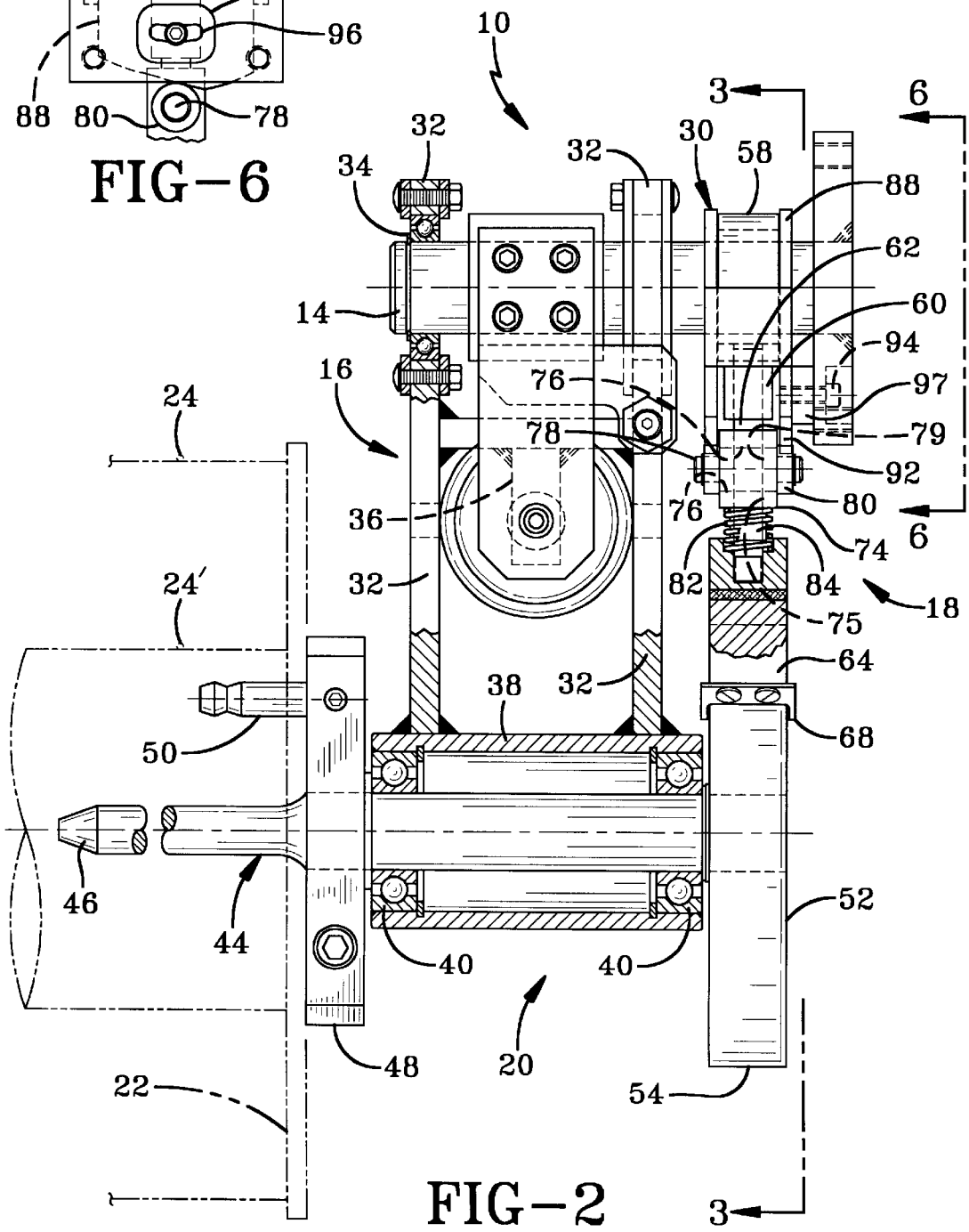
FIG. 2 is a fragmentary, side-elevational view with portions broken away, showing selected elements in section depicting details of a swing frame assembly and a braking assembly.
Figure 3:
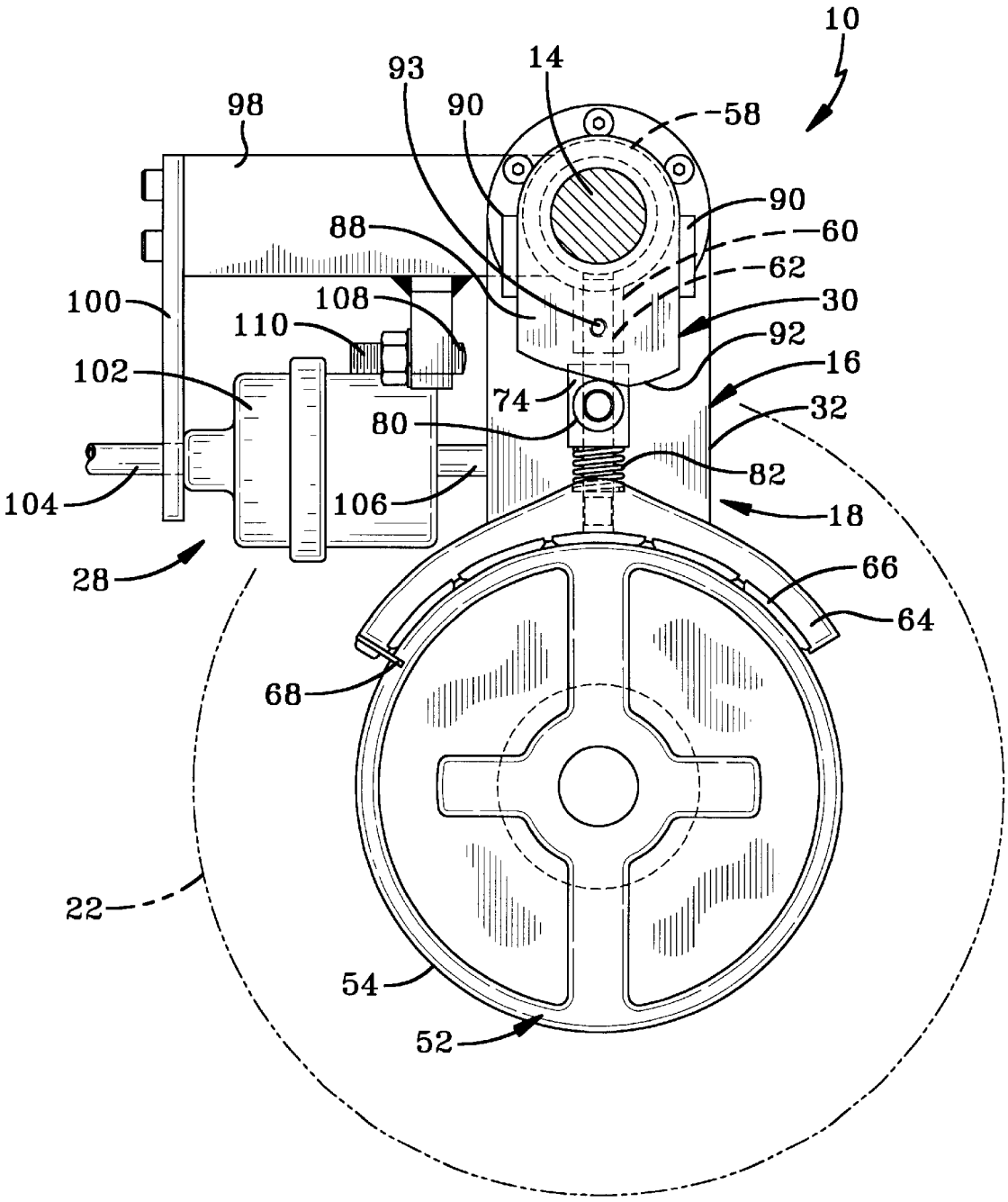
FIG. 3 is a cross-sectional view of the tension control device taken substantially along line 3—3 of FIG. 2, particularly showing elements of the braking assembly.

An exemplary self-compensating filament tension control device according to the concepts of the present invention is generally indicated by the numeral 10. As best seen in FIGS. 1, 2, and 6, the tension control device 10 includes a frame support 12 from which a fixed shaft 14 integrally extends. The frame support 12 may be part of a creel or other support structure which is part of a machine that processes individual strands of filamentary material into a finished manufactured item. It will be appreciated that the frame support 12 may also be employed to support multiple devices 10 as needed.

A swing frame assembly, generally indicated by the numeral 16, is pivotably mounted upon a distal end of the fixed shaft 14. Also pivotably mounted upon the fixed shaft 14 is a braking assembly generally indicated by the numeral 18. The braking assembly 18 is shown positioned between the swing frame assembly 16 and the fixed support 12. A spindle assembly, generally indicated by the numeral 20, carries a spool 22 which is shown in phantom. The spool 22 has wound thereon filamentary material 24, such as wire, yarns, threads, and the like, that are removed from the spool 22 for use in a finished end product. When rotational forces are applied to the spool 22, as a result of the tension force applied to the filamentary material 24, the swing frame assembly 16 and the braking assembly 18 pivot about the fixed shaft 14. A loading assembly, generally indicated by the numeral 28, is carried by the fixed shaft 14. In other words, the loading assembly 28 is not rotatable about the fixed shaft 14. The loading assembly 28 is operatively coupled to the swing frame assembly 16 to impart a predetermined load or balancing force to the swing frame assembly and the braking assembly 18. The interaction between the loading assembly 28 and the swing frame assembly 16 will be discussed in detail hereinbelow. A cam, generally indicated by the numeral 30, is operatively coupled to the braking assembly 18.

As will be further appreciated from the detailed description to follow, the swing frame assembly 16, the braking assembly 18, the spindle assembly 20, the loading assembly 28, and the cam 30 coact to control the pull-out of the filamentary material 24 from the spool 22. The device 10 provides a compact mechanism for running off the filamentary material in a straight flow path which then continues to an organizing system and/or calender. As the filamentary material is let off from the spool 22, the diameter of the filamentary material wound about the spool becomes smaller and has a reduced diameter of filamentary material 24' and the tension acting on the swing frame assembly 16 causes a braking force normally applied by the braking assembly 18 to be relieved by an increasing amount, thereby tending to keep the filament tension constant. The particular aspects of each of the major components will now be discussed in turn.

The swing frame assembly 16 includes a pair of opposed arms 32 rotatably mounted on the fixed shaft 14. In particular, a pair of ball or anti-friction bearings 34 are disposed between the fixed shaft 14 and the pair of opposed arms 32. A pivotable nose 36 connects the pair of opposed arms 32 to one another and is coupled to the loading system 28. The pivotable nose 36 is connected to the pair of opposed arms 32 so that both arms 32 pivot in a like manner. Attached to each end of the arms 32, opposite the fixed shaft 14, is a carriage 38 which has an anti-friction bearing 40 disposed within each end thereof.

The spindle assembly 20 includes a spindle 44 which is rotatably received in the carriage 38 and, in particular, is rotatable by virtue of contact with the anti-friction bearings 40. The spindle 44 includes a tapered end 46 to receive the spool 22. A spool stop 48 is fixed to the spindle and rotates therewith and is positioned between the tapered end 46 and the carriage 38. A drive pin 50 is cantilevered from the spool stop 48 at a position radially removed from the spindle 44. The drive pin 50 engages the spool 22 which causes the spindle 44 to rotate as the spool rotates. In other words, as tension is applied to the filamentary material 24 and withdrawn from the spool 22, the rotational moment applied to the spool is transferred to the spindle 44 by the drive pin 50 through the spool stop 48. A brake drum 52 is affixed to the other end of the spindle 44 and provides a brake surface 54 about the outer periphery thereof.

The braking assembly 18 is interposed between the fixed shaft 14 and the brake drum 52. Since the braking assembly 18 is coupled to the brake drum 52 and pivotably mounted upon the fixed shaft 14, it will be appreciated that the braking assembly 18 pivots with the swing frame assembly 16 when any forces are applied thereto. The braking assembly 18 includes a restraining bracket 58 that is rotatably carried by the fixed shaft 14. The restraining bracket 58 includes a collar 60 which slidably receives a pin 62. The opposite end of the pin 62 is attachably fixed to a brake shoe 64 which extends about a portion of the brake surface 54. The brake shoe 64 carries a plurality of friction pads 66 which are engagable with the brake surface 54. A retainer 68 extends from the brake shoe 64 to maintain alignment of the braking assembly 18 upon the brake drum 52. A block 74 has a pin hole 75. The block 74 also has a cross hole 76 that slidably receives a cross pin 78. The cross pin 78 has a transverse hole 79 that is alignable with the pin hole 75. As such, the block 74 and cross pin 78 are slidably movable on the pin 62. The cross pin 78 is held in place in the block 74 by a cam bearing 80 attached to each end thereof. A spring 82 is received on the pin 62 such that one end of the spring 82 bears against the block 74 while the opposite end of the spring bears against the brake shoe 64. A slidable sleeve 84 is diametrically disposed between the spring 82 and the outer diameter of the pin 62 and is sized to be somewhat shorter than the length of the spring 82 in an uncompressed condition. Accordingly, when the spring 82 is compressed a predetermined amount, the sleeve 84 comes in contact with a bottom edge of the block 74 and the top edge of the brake shoe 64 such that a braking force is fully applied to the braking surface 54. But, it will be appreciated that the sleeve 84 may or may not contact the bottom edge of the block 74 and the top edge of the shoe 64. Positioning of the sleeve depends on the operating pressure of the load at that operational setting. The stiffness of the spring 82 may be such that it alone will cause full application of the braking force.

The cam 30 is carried by the fixed shaft 14 and is secured thereto. As best seen in FIG. 2, the cam 30 has a pair of opposed plates 88 which are interconnected by a pair of cross bars 90. The opposed plates 88 are disposed upon the fixed shaft 14 such that the restraining bracket 58 is disposed therebetween. The ends of the opposed plates 88 opposite the fixed shaft 14 each provide a curvilinear camming surface 92 that engages a corresponding rotatable cam bearing 80. The plate 88 adjacent the fixed support has a threaded opening 93. A screw or other fastening device 94 is employed to connect the fixed support 12 to the opposed plate 88 with the opening 93. This functions to further secure the cam 30 to the fixed shaft 14. This precludes any pivotable movement from the braking assembly 18 to be imparted to the cam 30 and, as such, the cam is fixed and stationary upon the shaft 14, although, as will be explained, positioning of the cam may be adjusted.

As best seen in FIG. 6, the frame support 12 may be provided with a clearance pocket 95. Within the pocket 95, a curved slot 96 is provided. This allows selective positional adjustment of the cam 30, and in particular, the camming surfaces 92 with respect to the cam bearings 80. The threaded shaft of the screw 94 extends through the slot 96 for attachment to the threaded opening 93. The head of the screw 94 bears against the clearance pocket 95 when tightened. A spacer 97 is provided between the frame support 12 and the adjacent plate 88. The screw 94 passes through the spacer and is secured to the plate 88.

The loading system 28 includes a bracket 98 that is fixed to and cantilevered from the shaft 14. In this embodiment, the bracket 98 is shown positioned between the opposed arms 32 of the swing frame assembly 16. It will be appreciated by those skilled in the art that the bracket 98 could be mounted to the fixed support 12 or any other fixed immovable structure. In any event, a mounting bar 100 extends substantially perpendicularly downward from the bracket 98 and carries an air cylinder 102 at an opposite end. It will be appreciated that any other constant-force applying device such as a hydraulic piston or electrically powered motor could be secured to the mounting bar 100. In this embodiment, the air cylinder 102 provides a hose 104 to receive a supply of regulated air. A piston rod 106, which has a rod eye at a distal end, extends from the air cylinder 102 and is attached to the pivotable nose 36 by a pin through the rod eye. When the piston rod 106 is fully extended, the swing frame assembly 16 and the braking assembly 18 move away from the mounting bar 100. It is the primary purpose of the loading system 28 to apply a predetermined balancing force in a direction opposite the tension applied to the filamentary material 24. In the preferred embodiment, it has been determined that air pressure of about 0 to 1 bar is sufficient for imparting a loading force to the swing frame assembly 16.

A set stop 108 extends downwardly from the mounting bar 100 and provides an adjustable set screw 110 which precludes any over travel of the swing frame assembly 16 in the event of an excessive tension force applied to the filamentary material carried by the spool 22.

Figure 4:
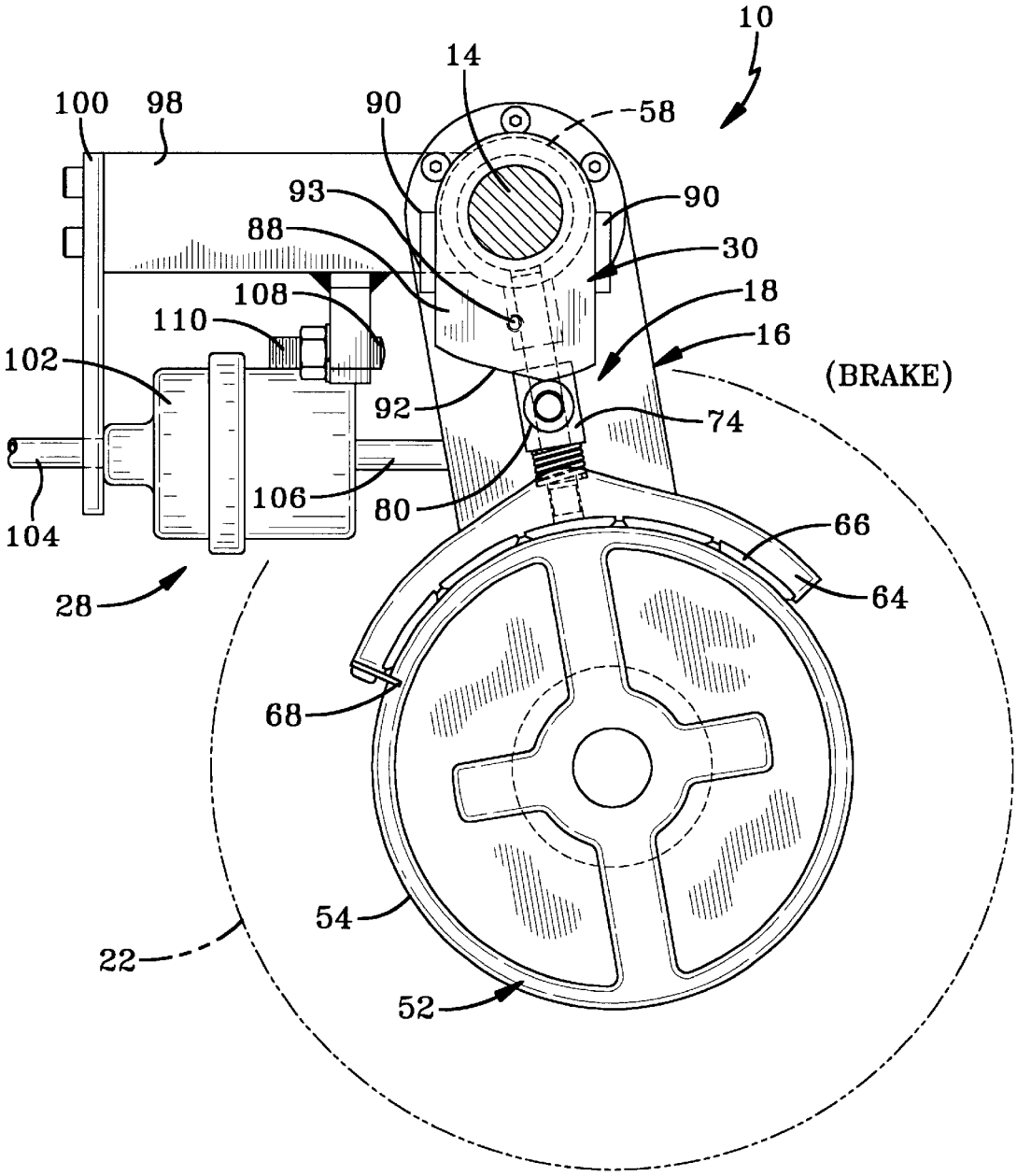
FIG. 4 is a view similar to FIG. 3, but showing the tension control device in a full braking position.

In operation, the spool 22 with filamentary material 24 wound thereupon is mounted upon the spindle 44 and the drive pin 50 is engaged. The person loading the spool 22 onto the device 10 will then pull the filamentary material to a machine such as a calender which applies a tension force thereto as it pulls and processes the filamentary material for use in an end product. Once the preliminary connection is made between the end of the filamentary material and the end process, the predetermined loading force is applied by the air cylinder 102 in a direction opposite the tension force applied by the filamentary material. Accordingly, both the swing frame assembly 16 and the braking assembly 18 are pivoted upon the shaft 14 in a direction opposite the tension force. As best seen in FIG. 4, the spool 22 is pivoted in a slightly counter-clockwise direction such that the cam 30 fully engages the braking assembly 18. In particular, the curvilinear camming surface 92 exerts or displaces the rotatable cam bearings 80 to an extent relating to the air pressure setting of the loading system 28. Exertion of this force by the camming surface 92 causes rotation of the cam bearings 80 and forces the cross pin 78 and the block 74 downwardly toward the spring 82. Accordingly, the block 74 exerts a downward pressure on the spring 82 and the brake shoe 64 such that the friction elements 66 engage the braking surface 54 to inhibit rotatable movement of the spindle 44 and of course, the spool 22.

Figure 5:
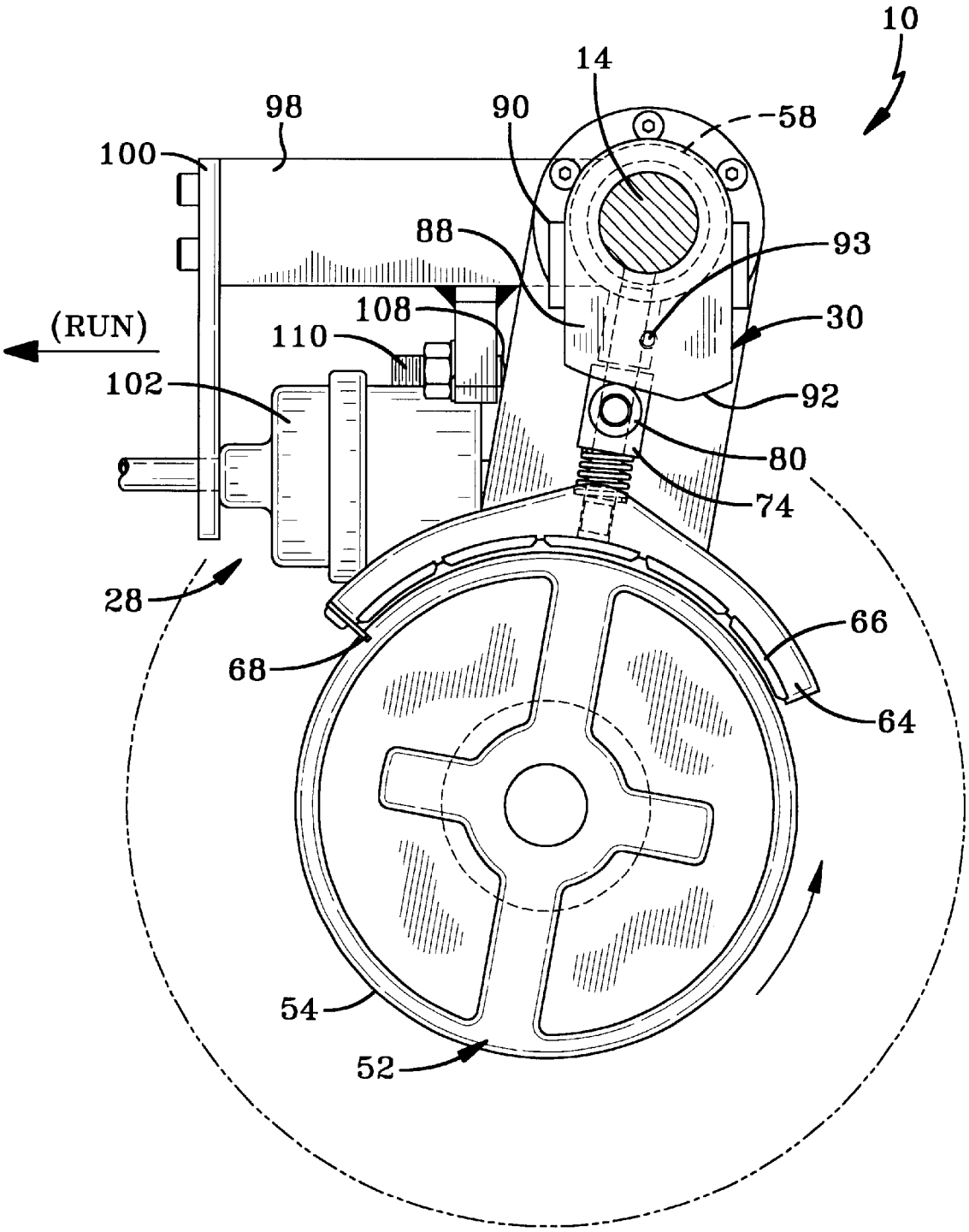
FIG. 5 is a view similar to FIG. 3, but showing the tension control device in a full brake-off position.

As a tension force is applied to the filamentary material, the predetermined loading force exerted by the air cylinder 102 begins to be overcome. This tension force is also required to pivotably move the swing frame assembly 16 and the braking assembly 18 in a clockwise direction (as seen in FIG. 5) about the fixed shaft 14. As a result, the cam bearings 80 are moved to a less extreme position upon the curvilinear camming surface 92 so as to relax the force applied by the block 74 upon the spring 82. This allows restrained rotation of the spool 22 and withdrawal of the filamentary material therefrom as best seen in FIG. 5. The adjustable set stop 108 is employed to stop over-travel of the swing frame assembly 16 in the event excessive tension force is applied to the filamentary material.

As the tension applied to the filamentary material varies, for example, when the moment arm from the fixed shaft 14 increases, the tension of the material 24 is easily regulated. In other words, as the spool of material unwinds, the torque created by the tension force acting on the swing frame assembly 16 tends to increase, thereby further relieving the spring pressure acting on the brake shoe 64. In the event the tension applied to the filament is immediately removed or significantly reduced, it will be appreciated that the air cylinder, which applies its predetermined constant loading force through the swing frame assembly 16 and braking assembly 18, will cause the swing frame assembly and braking assembly to pivot counterclockwise (as seen in FIG. 4) about the fixed shaft 14 and engage the brake shoe 64 upon the drum 52.

Based upon the foregoing, it will be appreciated that there are numerous advantages to the present invention. In the device 10, there is no need for a separate control arm or roller to assist in the guidance of the filamentary material. As such, the spool material is drawn directly from the spool 22. Since there is no separate control arm or roller, the device is less vulnerable to damage from over-tension possibly caused by entanglement of the spool of material. Since the material is pulled directly from the spool without passing over a roller mounted control arm, it is not imparted with a cast or distortion thereto. This has been found to be particularly advantageous when pulling heavy wire gage material.

Figure 7:
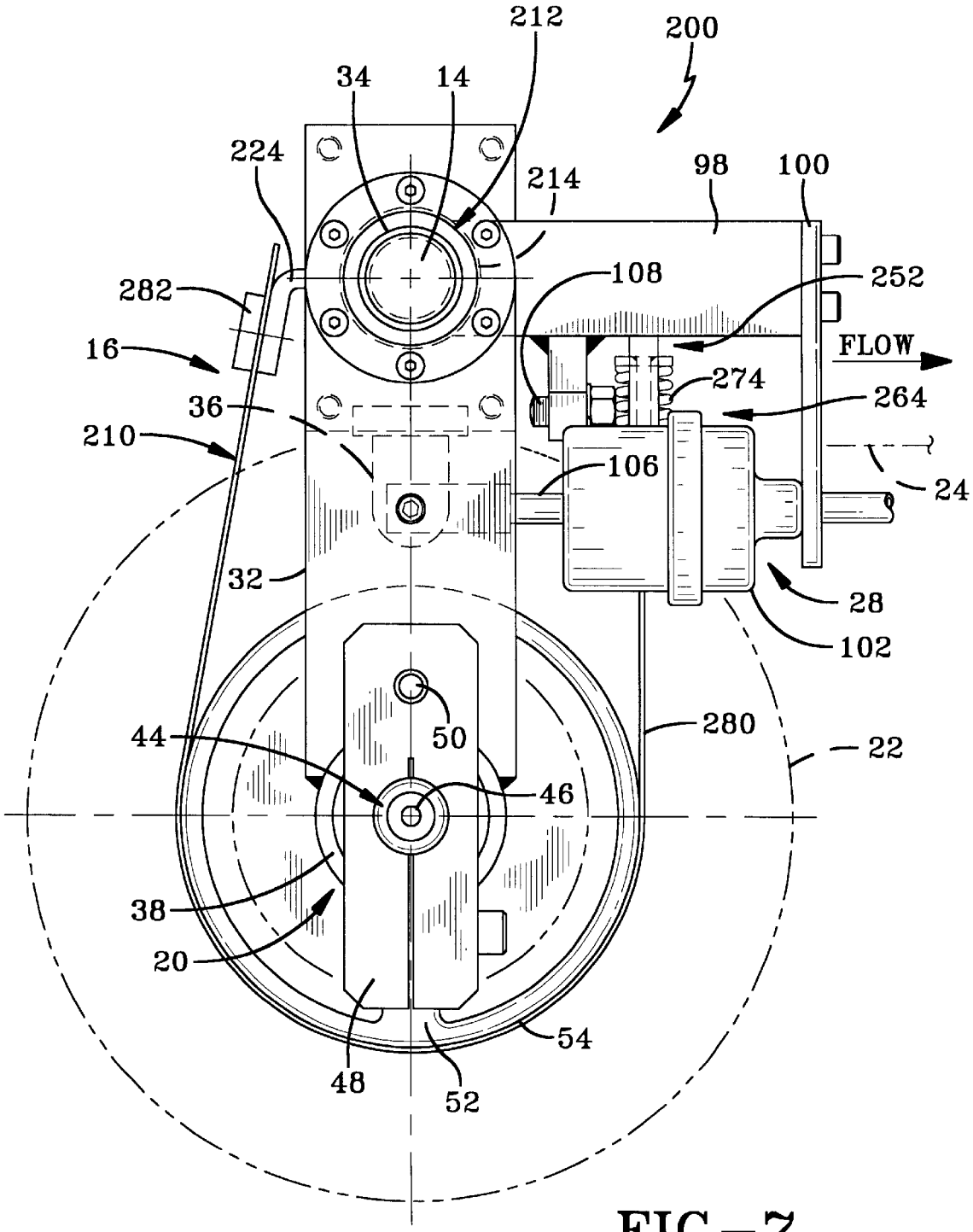
FIG. 7 is a front-elevational view of an alternative self-compensating filament tension control device, embodying the concepts of the present invention, wherein a spool of filamentary material is shown in phantom and wherein the device controls rotation of the spool.
Figure 9:
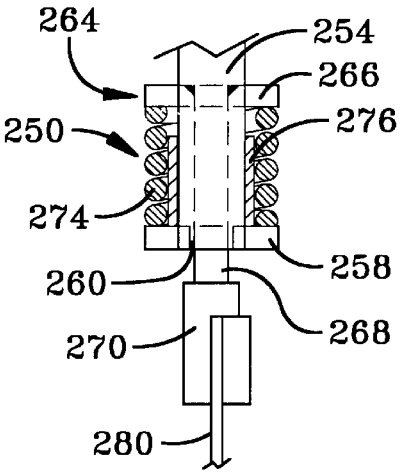
FIG. 9 is an enlarged view, with portions broken away, taken along line 9—9 of FIG. 8, showing selected elements of a spring assembly attached to one end of a band.
Figure 8:
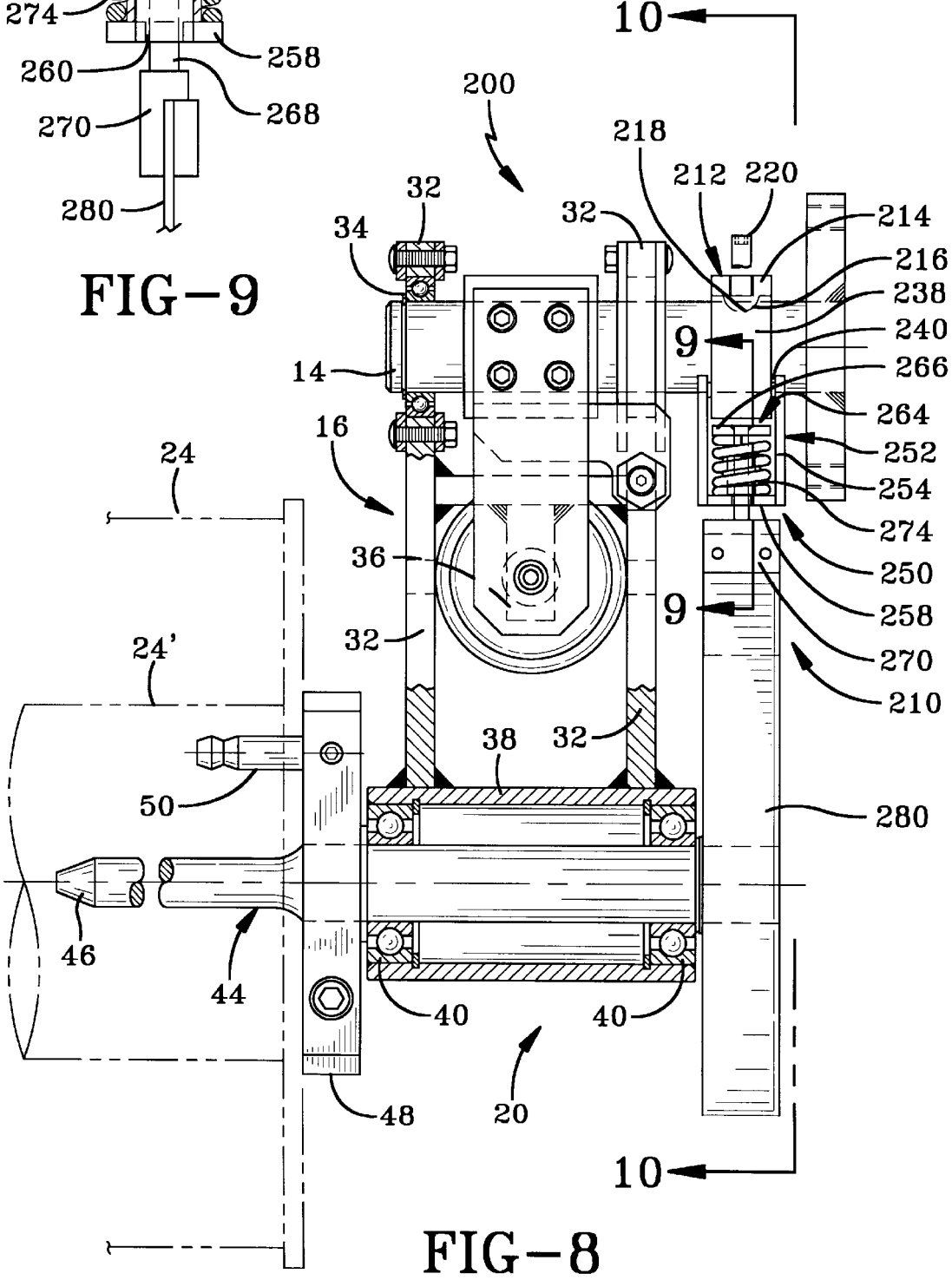
FIG. 8 is a fragmentary, side-elevational view with portions broken away, showing selected elements in section depicting details of a swing frame assembly and a band braking assembly.

An alternative and exemplary self-compensating filament tension control device employing a friction band, according to the concepts of the present invention, is generally indicated by the numeral 200. As best seen in FIGS. 7–9, the tension control device 200 is constructed in a manner substantially similar to the device 10. Accordingly, where appropriate, the same identifying numerals are used, such as for the frame support 12, the swing frame assembly 16, the spindle assembly 20, the load assembly 28, and the brake drum 52 which provides a brake surface 54 about the outer periphery thereof. Instead of using the braking assembly 18 shown in FIGS. 1–6, this embodiment employs a band braking assembly designated generally by the numeral 210. The band braking assembly 210 effectively replaces the braking assembly 18, the restraining bracket 58, and the brake shoe 64. Moreover, the cam 30 with its curvilinear camming surface 92 is not required in the alternative embodiment.

The band braking assembly 210 includes a ring 212 which is mounted upon the fixed shaft 14. The ring 212 includes a collar 214 which has a shaft key 216. The shaft 14 has a groove 218 that slidably receives the shaft key 216. A set screw 220 holds the collar 214 to the shaft 14 so as to prevent its rotation with respect to the shaft 14.

Figure 10:
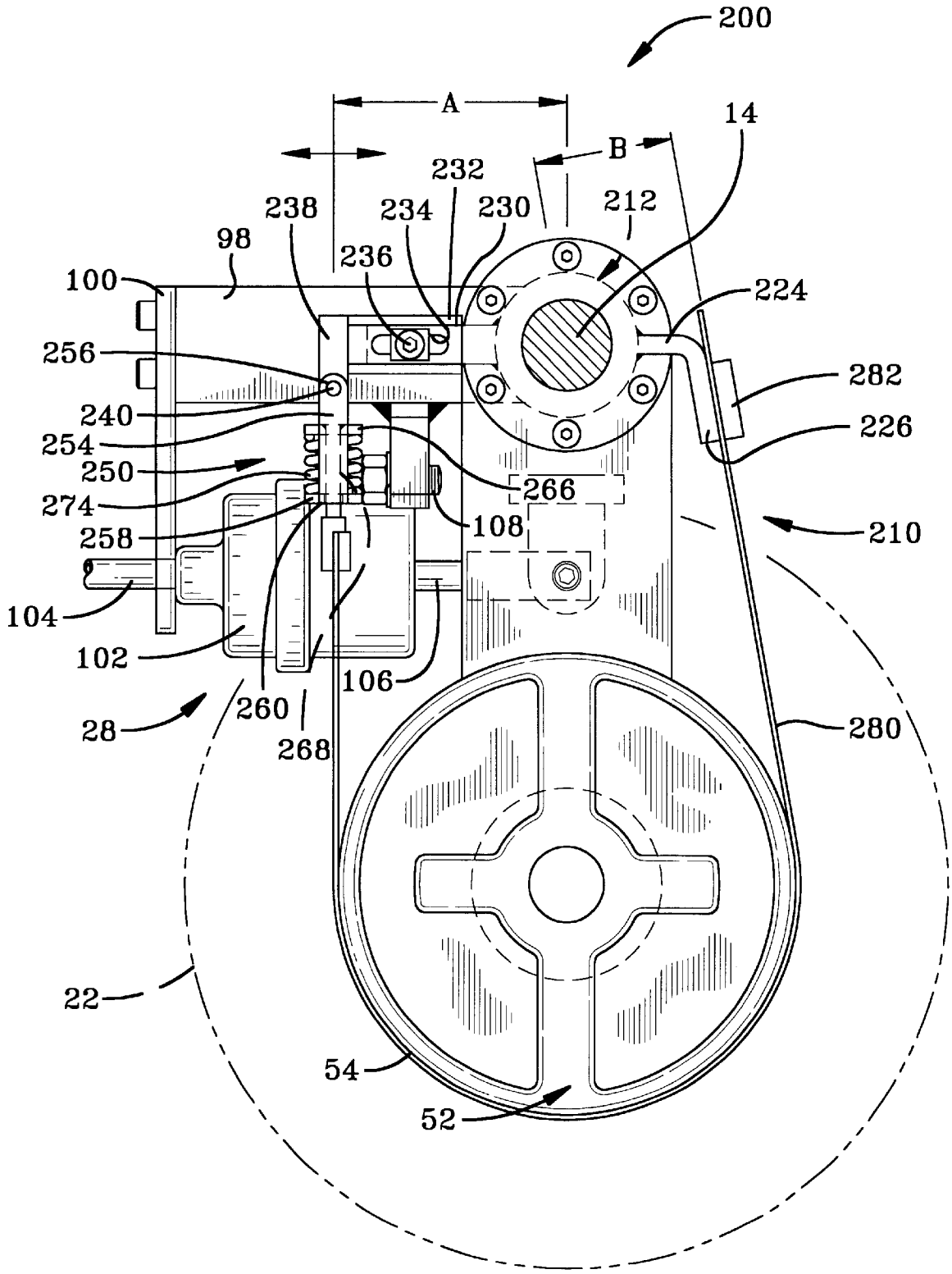
FIG. 10 is a cross-sectional view of the alternative tension control device taken substantially along lines 10—10 of FIG. 8, particularly showing elements of the band braking assembly.
Figure 11A:
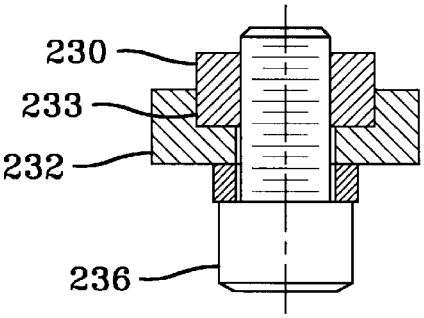
FIG. 11 is an elevational and a top view, in partial cross-section, of the device.
Figure 11:
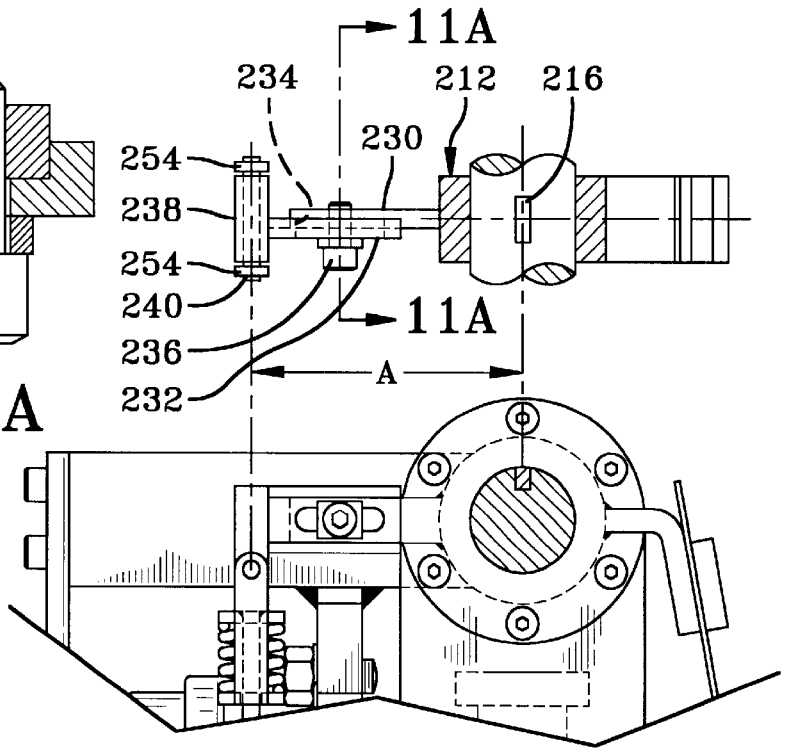

An angle arm 224 integrally extends from one side of the collar 214. As best seen in FIG. 10, the angle arm 224 extends substantially horizontally from the right side of the collar 214. A finger 226 extends angularly downward from the angle arm 224. As best seen in FIGS. 11 and 11A, extending substantially horizontally in an opposite direction from the angle arm 224 is a straight arm 230 that is also integral with the collar 214. In other words, the angle arm 224 and the straight arm 230 extend radially from the collar 214 in diametrically opposite directions.

An extension arm 232 is coupled to the straight arm 230. The extension arm 232 has a slot 234 which receives a clamping screw 236 received by the straight arm 230 that allows for slidable movement thereof. The extension arm 232 also has a channel 233 that slidably captures the straight arm 230. Accordingly, the length of the extension arm 232 may be adjusted by loosening the clamping screw 236, setting the extension arm to a desired position with respect to the straight arm 230 and then tightening the clamping screw 236. Extending perpendicularly downward from the extension arm 232 is an extension leg 238. A pin 240 extends transversely from each side of the extension leg 238.

A spring assembly, designated generally by the numeral 250, is coupled to the extension leg 238. In particular, the spring assembly 250 includes a pivot arm 252 which is pivotably mounted upon the pins 240. The pivot arm 252 includes a pair of opposed fingers 254, each of which has a hole 256 that slidably pivots about the respective pin 240. Connecting the opposed fingers 254 at an end opposite the holes 256 is an arm plate 258. The arm plate 258 is essentially perpendicular with respect to the opposed fingers 254 and has a shaft hole 260 therethrough.

A plunger assembly 264 is carried by the pivot arm 252. The plunger assembly 264 includes a spring plate 266 that fits between the opposed fingers 254. A shaft 268 extends from the arm plate 258 and is slidably received through the shaft hole 260. At the end of the shaft 268 is a tab 270.

A spring 274 is interposed between the arm plate 258 and the spring plate 266 in such a manner that the shaft 268 is slidably received internally to the spring 274. Accordingly, the spring plate 266 is biased with respect to the arm plate 258. If desired, a stop sleeve 276 may be concentrically interposed between the shaft 268 and the spring 274.

A braking band, designated generally by the numeral 280, is attached at one end to the tab 270 and is wrapped partially around the brake drum 52 and is attached at the other end to the finger 226. As such, the band 280 frictionally engages the braking surface 54. In the preferred embodiment, one end of the band 280 is fixably attached to the tab 270 and the other end is adjustably fixed by a clamping screw (not shown) or by a clamp 282 to the angle arm 224. This, along with positioning of the extension arm 232, allows for precise positioning of the band 280, depending upon the diameter of the brake drum 52 and other factors.

With reference to FIG. 10, it can be seen that the ends of the band 280 are positioned at different effective distances from the center of the fixed shaft 14. The leftmost dimension line of dimension A shows that the extension arm 232 may be adjustably positioned from the center of the shaft 14. In the preferred embodiment, the extension leg 238, via the extension arm 232, is positioned so as to be substantially parallel with the vertical axis of the frame support 12. Dimension B shows that the finger 226 effectively positions the other end of the band 280 a shorter distance away from the center of the shaft 14 than dimension A. The angular orientation of the finger 226 permits the shorter distance while still allowing tangential engagement of the band 280 with the braking surface 54.

Figure 12:
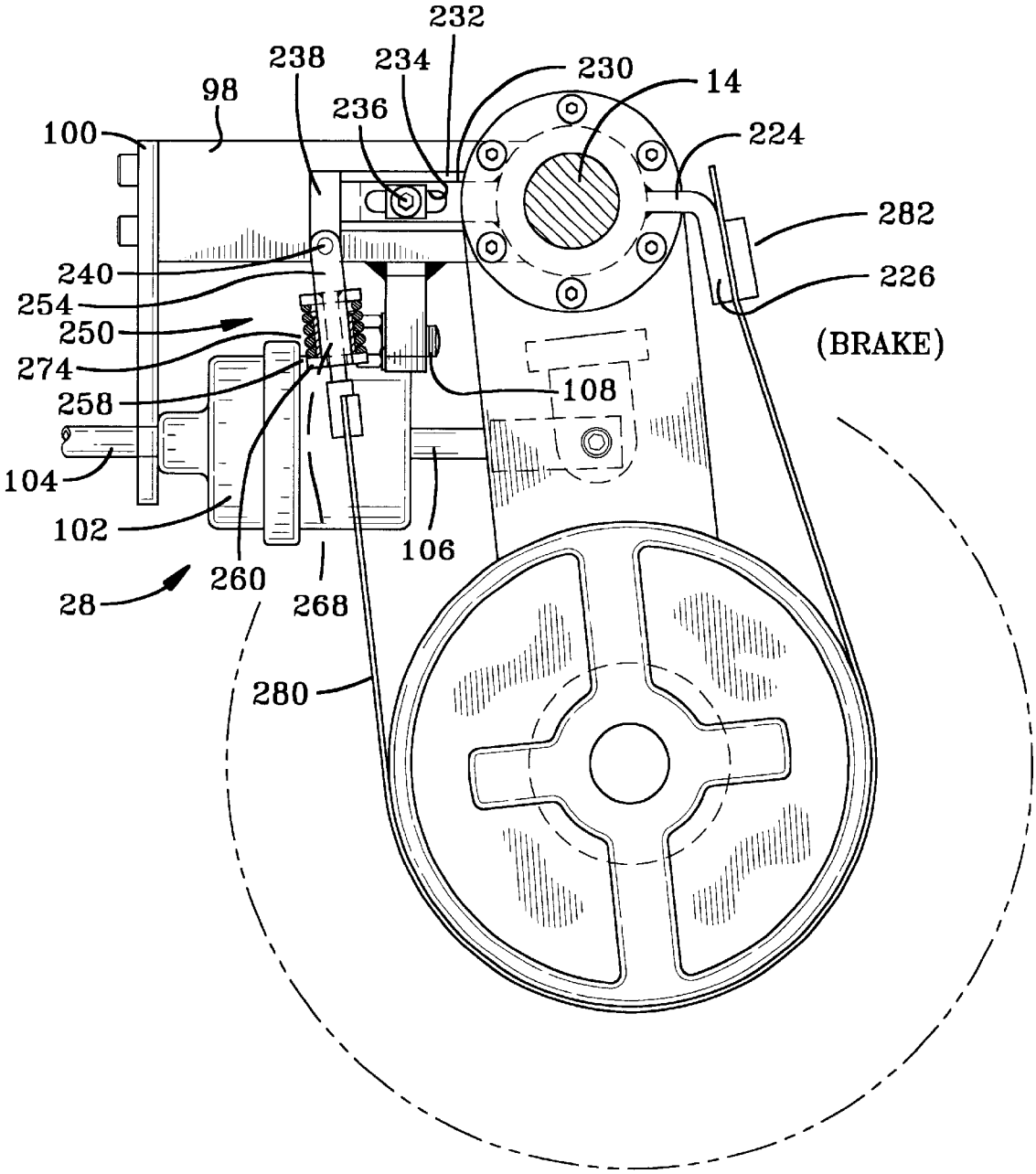
FIG. 12 is a view similar to FIG. 10, but showing the alternative tension control device in a full braking position.
Figure 13:
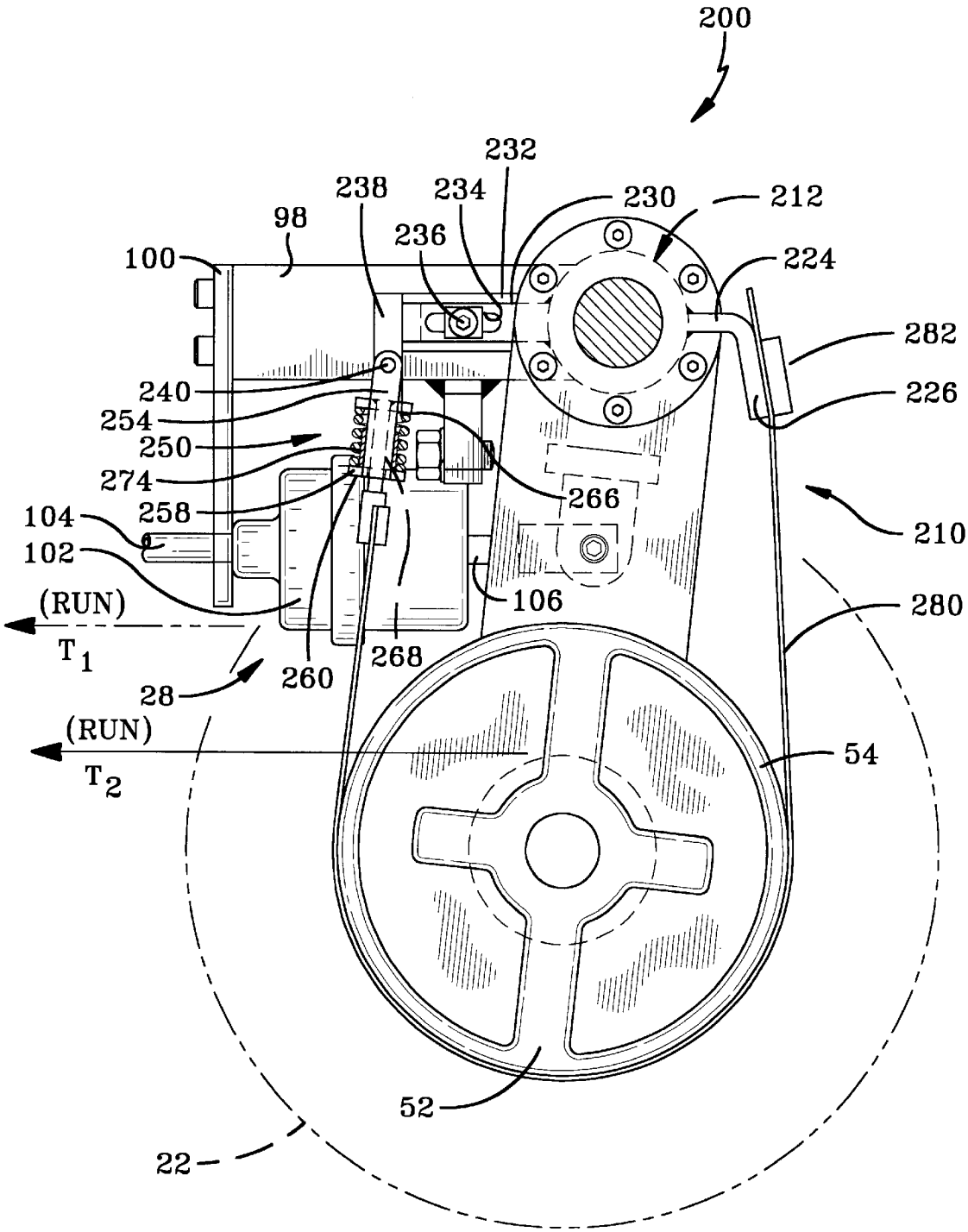
FIG. 13 is a view similar to FIG. 8, but showing the alternative tension control device in a brake-off condition.

Referring now to FIGS. 12 and 13, the operation of the device 200 will be discussed. As in the previous embodiment, the spool with the filamentary material 24 is mounted on the spindle and the drive pin 50 is engaged. Once all the connections are made to the free end of the filamentary material, a predetermined loading force is applied by the air cylinder 102 in a direction opposite the tension force to be applied by the filamentary material. Accordingly, the swing frame assembly 16 and the spindle assembly 20 pivot upon the shaft 14, and the braking assembly 210 flexes in a direction opposite the tension force. As best seen in FIG. 12, the spool 22 is pivoted in a slightly counter-clockwise direction such that the brake drum 52 is directed into that portion of the band which has the shortest distance to the center of the fixed shaft 14 (dimension B). Accordingly, the band 280 tightens onto the braking surface 54 and rotation of the spool 22 is impeded. As the band 280 tightens, the spring 274 is slightly compressed when the spring plate 266 is pulled toward the arm plate 258 during pivoting of the swing frame assembly. In order to prevent complete compression of the spring 274, the stop sleeve 276 prevents the spring plate 266 from pulling too far. This prevents over-travel of the swing frame assembly 16.

As tension forces are applied to the filamentary material, designated by $T_1$ and $T_2$ in FIG. 13, the predetermined loading force exerted by the air cylinder 102 is overcome. To start, the tension force $T_1$ pivotably moves the swing frame assembly 16, the spring assembly 250, and the braking band 280 in a clockwise direction about the fixed shaft 14. As a result, the brake drum 52 is positioned within the larger dimension A and the braking force applied to the drum 52 is released or at least proportionately reduced. In other words, as the filamentary material pays out, the diameter of the material wound on the spool becomes smaller and the pull of the material $T_2$ causes the swing assembly 16 to pull farther to the left because of the increased moment acting upon the swing assembly, thus relieving the braking friction to a greater degree, thereby tending to compensate for the rising tension caused by the smaller diameter of the wire wound upon the spool. This embodiment may also be provided with the adjustable set stop 108 to stop over-travel of the swing frame assembly 16 in the event an excessive tension force is applied to the filamentary material. The biasing action of the plunger assembly 264 also functions to ensure smooth transition between a braking force and a running force, depending upon the amount of tension applied to the filamentary material.

As the spool of material unwinds, the torque created by the tension force acting on the swing frame assembly 16 tends to increase, thereby further relieving the braking surface area applied by the band 280 on the braking surface 54. In the event the tension applied to the filament is immediately removed or significantly reduced, it will be appreciated that the air cylinder, which applies its predetermined constant loading force through the swing frame assembly 16 and braking assembly 210, causes the swing frame assembly and the braking assembly to pivot counter-clockwise, as seen in FIG. 12 about the fixed shaft 14 and pivot the braking surface to the shorter dimension B. This re-applies the braking force and slows rotation of the spindle.

Based upon the foregoing, it will be appreciated that this embodiment provides an alternative construction while achieving all of the advantages of the first embodiment disclosed.

Thus, it should be evident that the disclosed device carries out the objects of the invention set forth above. As apparent to those skilled in the art, modifications can be made without the departing from the spirit of the invention herein disclosed and described, the scope of the invention being limited solely by the scope of the attached claims.

What is claimed is:

1. A self-compensating tension control device for regulating the payout of filamentary material from a spool, comprising:

a fixed support;

a spindle assembly pivotably mounted to said fixed support, said spindle assembly rotatably carrying the spool of filamentary material, wherein a pull-off force imparted by the filamentary material causes angular movement of said spindle assembly and rotation of the spool; and a braking assembly mounted to said fixed support and coupled to said spindle assembly, wherein the amount of braking force applied by said braking assembly corresponds to an angular position of said spindle assembly; and a band having one end fixed a first distance from said fixed support in a first direction and an opposite end biasingly fixed at a second distance from said fixed support in a second direction substantially opposite said first direction, said band engaging said spindle assembly and applying a braking force thereto when said spindle assembly is in an angular position directed toward a shorter of said first and second distances.

2. The device according to claim 1, said braking assembly further comprising:

a ring mounted on said fixed support;

an angle arm which extends said first direction from said ring; and a straight arm which extends said second distance from said ring, wherein said straight arm is adjustable to vary said second distance.

3. The device according to claim 2, said braking assembly further comprising:

a spring assembly connecting said straight arm to said opposite end of said band.

4. The device according to claim 3, said spring assembly comprising:

a pivot arm pivotably extending from said straight arm, said pivot arm having an arm plate with a shaft hole therethrough;

a plunger assembly having a spring plate with a shaft extending therefrom that extends through said shaft hole and is connected to said opposite end of said band; and a spring interposed between said arm plate and said spring plate for biasing said opposite end of said band.

5. The device according to claim 4, wherein said spring assembly further comprises:

a stop sleeve received upon said shaft and within said spring, said stop sleeve limiting travel of said spring plate with respect to said arm plate.

6. The device according to claim 2, further comprising:

an extension arm slidably attached to said straight arm; and a set screw for holding said extension arm in a fixed position with respect to said straight arm.

7. A self-compensating tension control device for regulating the payout of a filamentary material from a spool, comprising:

a fixed support;

a spindle assembly pivotably mounted to said fixed support, said spindle assembly rotatably carrying the spool of filamentary material, wherein a pull-off force imparted by the filamentary material causes angular movement of said spindle assembly and rotation of the spool, said spindle assembly having a brake drum rotatable therewith; and a band mounted at both ends to said fixed support and contacting said brake drum, said band having one end fixed a first distance from said fixed support and an opposite end fixed at a second distance from said fixed support in a direction substantially opposite said first direction, said band engaging said brake drum and applying a braking force thereto when said spindle assembly is in an angular position directed toward a shorter of said first and second distances.

8. The device according to claim 7, wherein said opposite end of said band is biasingly fixed.

9. The device according to claim 7, wherein said second distance is adjustable to allow for adjustment of the braking force applied.

10. The device according to claim 7, further comprising a loading assembly fixably mounted to said fixed support and coupled to said spindle assembly and imparting an initial threshold to said spindle assembly to cause engagement with said band.

* * * * *